United States Patent [19]

Cohn

[11] 3,965,851

[45] June 29, 1976

[54] APPARATUS FOR APPLYING SEALING MATERIAL TO ENVELOPES

[75] Inventor: Robert Cohn, Millbrae, Calif.

[73] Assignee: Champion International Corporation, Stamford, Conn.

[22] Filed: July 19, 1974

[21] Appl. No.: 490,203

[52] U.S. Cl. ..... 118/1; 118/9; 118/32; 118/212; 118/236; 118/239; 118/620

[51] Int. Cl.[2] ..... B05C 1/02; B05C 13/02

[58] Field of Search ..... 118/236, 239, 32, 212, 118/620, 9, 249; 219/10.69, 10.81; 156/442.1

[56] References Cited

UNITED STATES PATENTS

| | | | |
|---|---|---|---|
| 1,120,688 | 12/1914 | Carrington | 156/442.1 |
| 1,678,705 | 7/1928 | Muller | 101/236 |
| 2,625,085 | 1/1953 | Bergstein | 118/1 X |
| 2,748,025 | 5/1956 | Sackett et al. | 118/239 X |
| 2,807,699 | 9/1957 | Moore | 219/10.69 |
| 3,293,765 | 12/1966 | Winkler et al. | 219/10.69 X |
| 3,619,538 | 11/1971 | Kallenburn et al. | 219/10.81 X |
| 3,811,407 | 5/1974 | Lupkas et al. | 118/32 |
| 3,866,255 | 2/1975 | Serota | 219/10.81 X |

FOREIGN PATENTS OR APPLICATIONS

| | | | |
|---|---|---|---|
| 621,776 | 10/1935 | Germany | 118/32 |

*Primary Examiner*—John P. McIntosh
*Attorney, Agent, or Firm*—Anthony J. Casella

[57] ABSTRACT

An apparatus for applying latex sealing material to the facing closure flap and opposed body portion of an envelope includes a continuous belt driven conveying means having a generally triangular path, with the envelopes being fed onto the conveying means at one point in the triangle, with the conveying means gripping each of a series of envelopes along its folded edge portion opposite the flap. As the envelopes are conveyed, the flap is first unfolded through an angle of approximately 180° to a generally horizontal position, after which the envelope is passed between an impression roller and a latex applicator roller at which latex is applied to the facing closure flap and the body portion of the envelope. The impression roller and glue roller are disposed at the second point of the triangular path of the conveying means, and next the envelopes are passed through a dielectric dryer for drying the latex sealing material. Upon leaving the dielectric dryer, the path of the conveyor means passes through the third point of the triangle, and progresses back toward the original starting point. At the latter point, means are provided for removing the envelopes from the conveyor means. By this arrangement, a single operator may readily feed and unload the apparatus of the subject invention. In the method for applying strips of latex to the envelope, the envelopes are fed to the conveying means, the flap closures are sequentially rotated to a generally horizontal position in order to next enable the application of latex to both the inside surface of the flap closure and the opposed body portion of the envelope, after which, the envelopes are passed through a dielectric dryer means to dry the latex material. Finally, the envelopes are removed from the conveying means and stacked.

23 Claims, 9 Drawing Figures

APPARATUS FOR APPLYING SEALING MATERIAL TO ENVELOPES

BACKGROUND OF THE INVENTION

The subject invention relates to a method and an apparatus for applying sealing material such as latex or adhesive to portions of flat or folded sneets, papers, bags, or the like, and more particularly to a method and apparatus for applying latex to the flap closure portion and the adjacent body portion of an envelope whereby when the latex portions are placed in overlapping relationship and pressure is applied, the envelope may be sealed.

It is to be understood that although the method and apparatus of the subject invention will be described with respect to the application of sealing materials, in general, it has particular application to a method and apparatus for the application of latex to an envelope flap and the cooperating portion of the envelope body in order to effect a seal. As is well known, the use of latex as a sealing material has the advantage that when the portion of the flap and the portion of the envelope body to which the latex has been applied, are brought into contact with each other and pressure applied thereto, the flap will be effectively sealed to the body of the envelope, without the requirement of the application of moisture to the latex material. The use of latex as an envelope sealing material is well known, however it has been found that known methods and techniques are not capable of applying the latex at a sufficient rate of speed to justify the costs involved in using latex. For instance, present day equipment is capable of gumming envelopes at a speed of approximately 12,000 envelopes per hour, of course, depending on the envelope size and amount of latex applied. Although this may appear to be a high rate of speed, it should also be borne in mind that in the United States alone, roughly 100 billion envelopes are manufactured each year. Thus a great number of machines are required for applying sealing material, and hence it would be most advantageous if increased production could be obtained from each machine. To a great extent the limitation on the number of envelopes that may be processed by each machine is limited by the use of conventional forced air heating means for drying the latex after it has been applied to the envelope. Another shortcoming of present equipment and techniques is the difficulty that has been encountered in the proper application of the latex to the envelopes. As an example, it is extremely undesirable to have the latex, which is applied to the envelope flap and/or body, extend completely from one end of the flap to the other edge thereof because the latex has a tendency to bead or run over the edges, and thus produce a messy, unsatisfactory envelope which, when the envelope is sealed, will have excess visible latex. In addition, the improper application of latex to the envelope body or flap may result in beads along the edges of the envelope body or flap, thereby requiring the slower drying of the latex, which again reduces the production capability of conventional apparatus. Still furthermore, it has been found that when unsealed envelopes are stacked, they will not stick together if the sealing material terminates inwardly of the envelope edges. Thus, by carefully controlling and ensuring that the latex is disposed back from the edges of the envelope, it is easier for the operator to feed the envelopes through a printing or packaging machine.

Another disadvantage of present equipment and techniques for the application of latex to envelopes is the occurrence of bubbles or voids in the latex which also results in an unattractive envelope, as well as one which may not seal perfectly.

Still another shortcoming of known equipment and techniques is the necessity for the operator to load the blank envelopes into the apparatus at one end of the machine, and then unload the apparatus at the opposite end of the machine, whereby the speed of operation of the machine is determined by the efficiency of the operator in traversing the distance between the opposite ends of the machine or using more than one operator.

In other known apparatus, there is also the arrangement wherein a plurality of converyors are provided, one for each step in the process, thereby necessitating the transfer of the series of envelopes from one conveyor to other conveyors, which results in extremely large machines that occupy large areas, and also require the operator to traverse long distances in order to load and unload the envelopes.

Accordingly, it is the object of the subject invention to overcome the shortcomings of known apparatus and methods for applying sealing material to envelopes, and more particularly to provide a new and approved method and apparatus for applying latex to envelopes in a rapid, efficient, and neat manner, which method and apparatus can readily and easily handle various size envelopes at greater speeds then heretofore achieved.

It is another object of the subject invention to provide a new and improved method and apparatus for achieving increased rates of production of applying sealing material to envelopes, while achieving better quality of the resulting application of latex material to the envelopes in order to obviate running, voiding, bubbling or blistering of the latex material.

It is a further object of the subject invention to provide an apparatus and method which employs a dielectric dryer for drying the sealing material applied to the envelope in order to achieve greater production rates.

It is still a further object of the subject invention to provide a method and apparatus for applying sealing material to envelopes wherein the envelopes are conveyed in a continuous process by a single conveyor means thereby greatly reducing the cost of manufacture of the apparatus.

Still another object of this invention is to provide a method and apparatus for applying sealing material to envelopes wherein a continuous conveying means is employed for conveying the envelopes, and wherein the operator feeds and removes enevelopes from the conveying means from a single location.

It is a further object of the subject invention to provide a new and improved method and apparatus for applying sealing material to envelopes wherein a continuous conveying means is employed and is capable of conveying two linear arrays of envelopes at the same time in order to obtain increased production.

It is another object of the subject invention to provide a new and improved apparatus for applying sealing material to envelopes wherein the envelopes are fed into the machine in their normally packaged condition in which the closure flap is folded against the body portion, and which method and apparatus includes means for unfolding the flap preparatory to the application of adhesive to the undersurface of the closure flap.

Still another object of the subject invention is to provide a new and improved method and apparatus for applying sealing material to envelopes wherein dielectric dryer means are provided for rapidly and efficiently drying the adhesive applied to the envelopes, which dielectric drier means includes an alternating arrangement of a plurality of a generally parallel electrodes and ground conductors, connected to a central power supply.

SUMMARY OF THE INVENTION

These and other objects and advantages are realized by the subject invention by the provision of an apparatus including drive means, an endless continuous conveying means which is connected to the drive means and has a generally triangular path, and is adapted for conveying a single series, or two series of envelopes, with the conveying means gripping each envelope along the folded edge portion thereof. Feeding means are provided for successively feeding each envelope onto the conveying means in a generally horizontal plane with the closure flap of each envelope facing downwardly. As the envelopes are carried by the conveying means, flap opening means are provided for unfolding the flaps and rotating same about 180° so that the flaps assume generally horizontal positions. At an apex of the triangular shaped path of the conveying means, sealing material such as latex is applied to the inside surface of the flap closure and also the body portion of the envelope. Sealing material applicator means comprises an impression roller disposed inside the triangular shaped conveying means at a corner thereof, while disposed underneath the conveying means is a glue roller having die portions to which latex material is applied, which die portions successively engages the linear array of envelopes so as to apply the sealing material to the surface of the flap closure and the body of the envelope. The apparatus further includes a dielectric dryer means through which the continuous conveyor passes so as to dry the latex material. When each envelope returns to a position in the vicinity of the feeder means, means are provided for removing the envelopes from the conveyor, and by this arrangement the operator of the apparatus may feed and remove envelopes from a single location. It is noted that only a single conveyor is provided, and the employment of the dielectric dryer means enables the rapid and efficient application of the sealing material to the envelopes.

In the method of the subject invention, a series of envelopes are conveyed in a continuous process wherein the envelopes are first fed to the conveying means, each flap closure is rotated to a generally horizontal position, sealing material is applied to the flap closure and the body portion of the envelope, the envelopes are then passed through a dielectric drier means to dry the sealing material, and having returned to near the initial point, the envelopes are removed from the conveyor means.

DESCRIPTION OF PREFERRED EMBODIMENT

Figure 1:
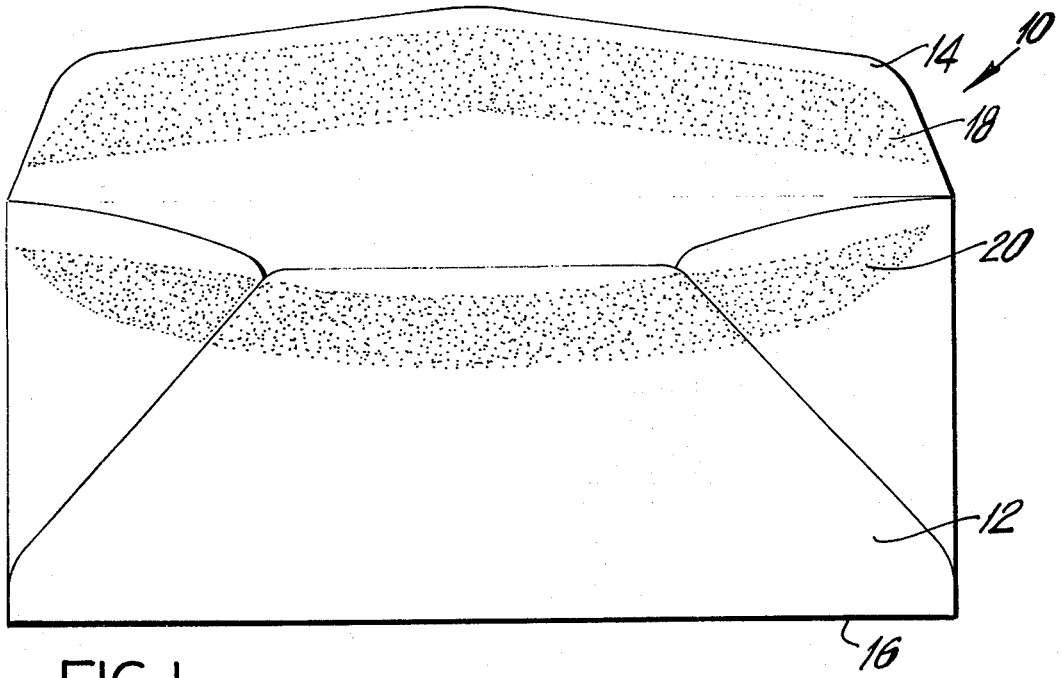
FIG. 1 is a plan view of an envelope to which strips of sealing material have been applied.

Referring to FIG. 1, an envelope 10 includes a body portion 12 formed of a plurality of sections bonded together with one open end to which is integrally formed the closure flap 14, while opposite to said closure 14 is a folded edge 16 of the envelope. The subject apparatus and method is concerned with the application of latex sealing material 18 to the closure flap 14, and a similarly configures latex 20 to the body portion of the envelope. As noted above, when the latex is applied to the closure flap and body portion, and said latex applications are pressed together, a closure seal is effected for the envelope.

Figure 2:
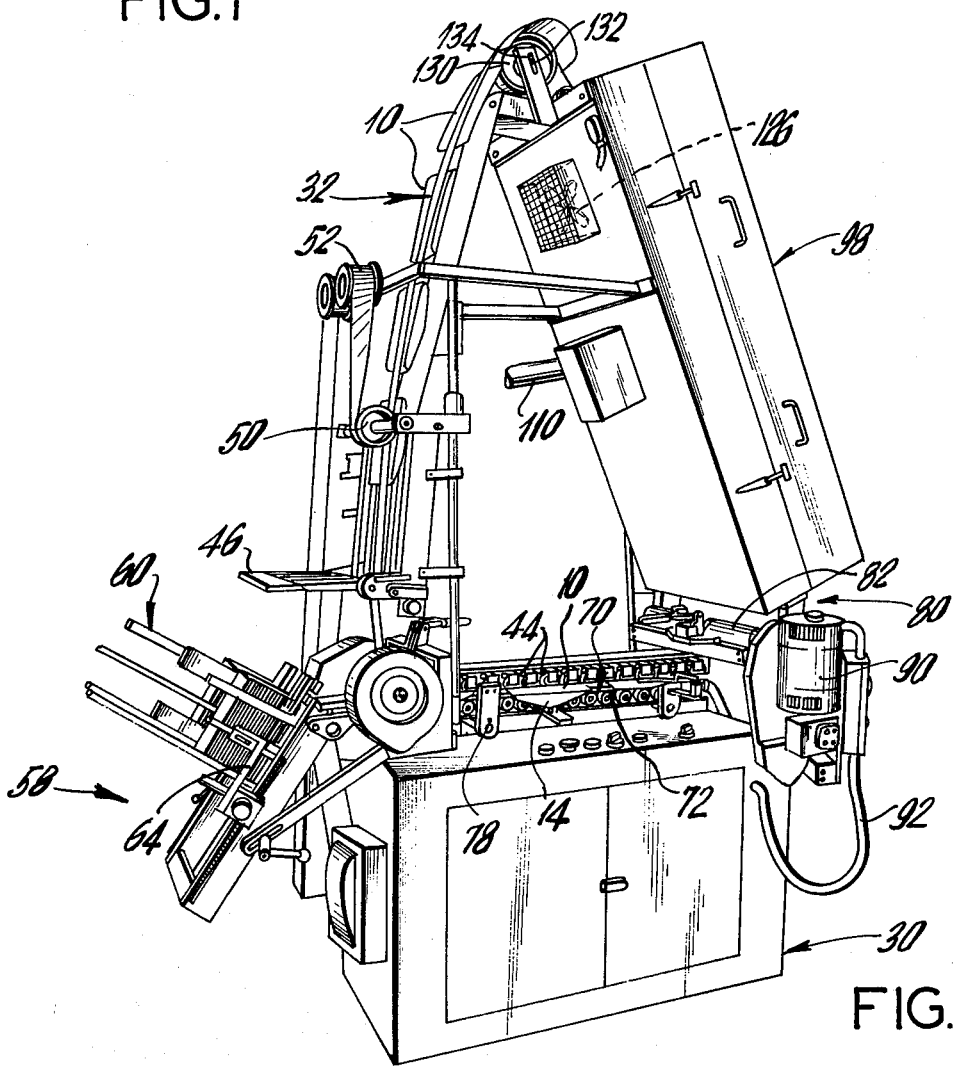
FIG. 2 is a perspective view of the apparatus for applying sealing material to an envelope according to the subject invention.
Figure 5:
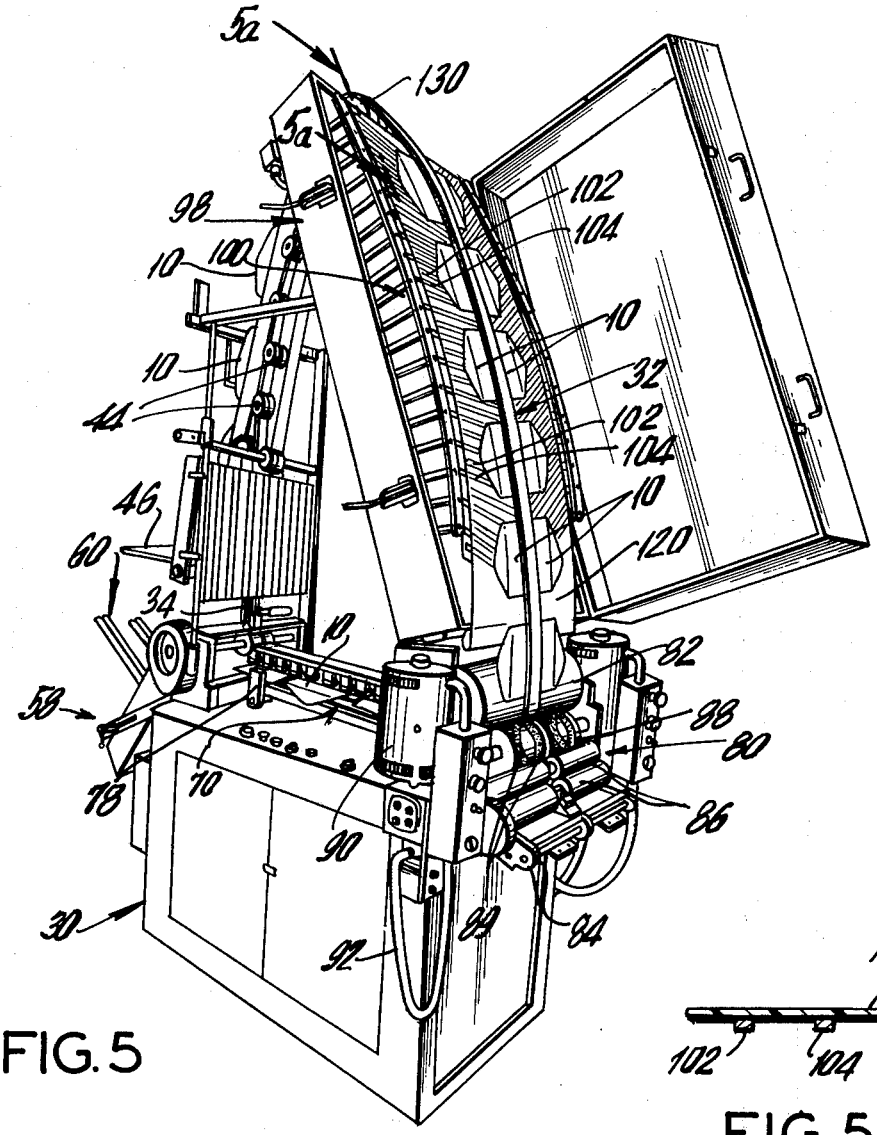
FIG. 5 is a perspective view of the subject apparatus with the housing door for the dielectric dryer being in the open position in order to illustrate the details of the construction of the dielectric dryer.
Figure 7:
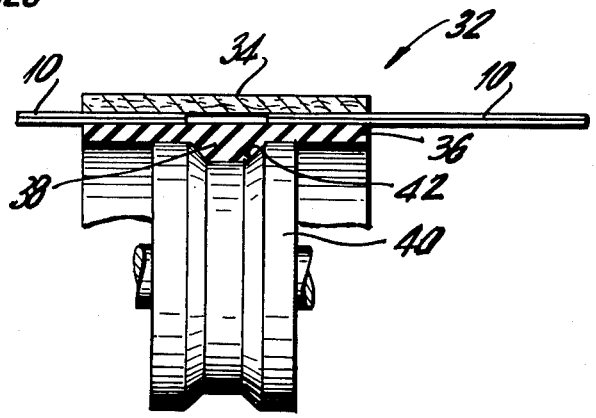
FIG. 7 is a sectional view illustrating the construction of the conveyor means of the subject apparatus.
Figure 8:
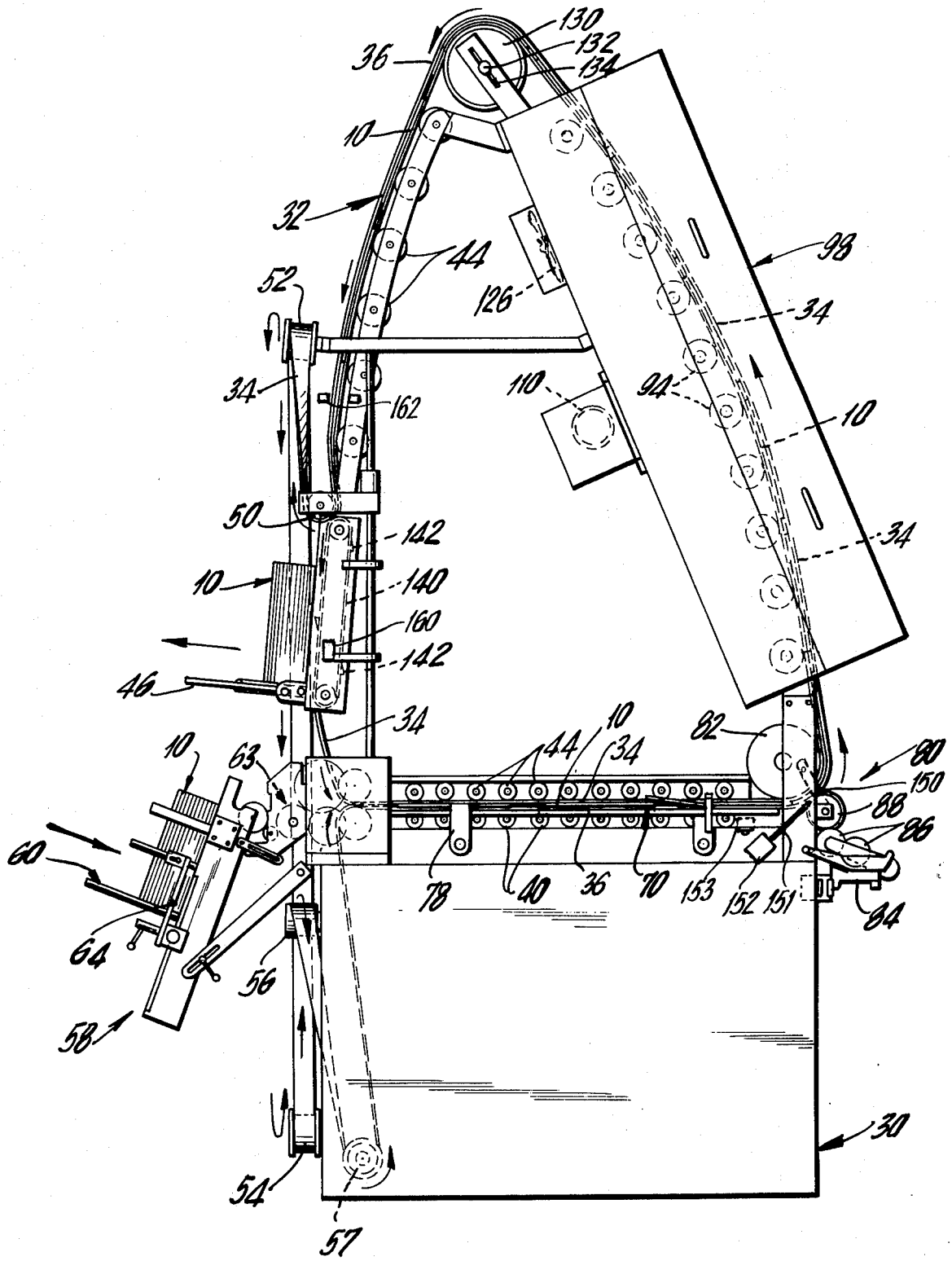
FIG. 8 is a longitudinal sectional view of the subject apparatus.

Referring now to the drawings, and more particularly to FIGS. 2, 5 and 8, it will be seen that the subject invention includes a stationary supporting structure 30 which houses the drive motor and controls for driving a continuous coveyor means 32 which follows a generally triangular path. More particularly, the conveyor means comprises two belts, an outer, flat canvas belt 34 (see FIG. 7), and an inner, rubber covered belt 36 having an integral, central v-guide section 38 that is adapted to engage the inner conveyor rolls 40 that are similarly configured so as to have a corresponding v-groove 42. The inner v-guided belt 36 is guided by means of conveyor rolls 44 (see FIG. 8) disposed throughout the entire path of the conveyor means. The outer canvas belt 34 engages the inner belt throughout most of the triangular path of the conveyor means, except at the point where the envelopes are delivered to the delivery table 46, to be more fully described hereinafter. At this point the outer belt passes over a series of upper conveyor idler pulleys 50, 52, thence over lower conveyor idler pulleys 54 and 56 to the drive motor pulley 57 in the stationary supporting structure 30, and thence back to the feeding station for the envelopes where the canvas belt 34 meets the rubber covered belt 36. It is noted that the integral v-guide strip 38 of the inner belt 36 is operative to maintain proper alignment of the conveyor means 32 throughout its path, as well as insuring proper drive between the drive converyor rolls and the canvas belt 34. It is also noted that the outer canvas belt 34 is employed since canvas inherently has a certain amount of give or stretch which enables the smooth operation of the conveyor means 32.

Figure 3:
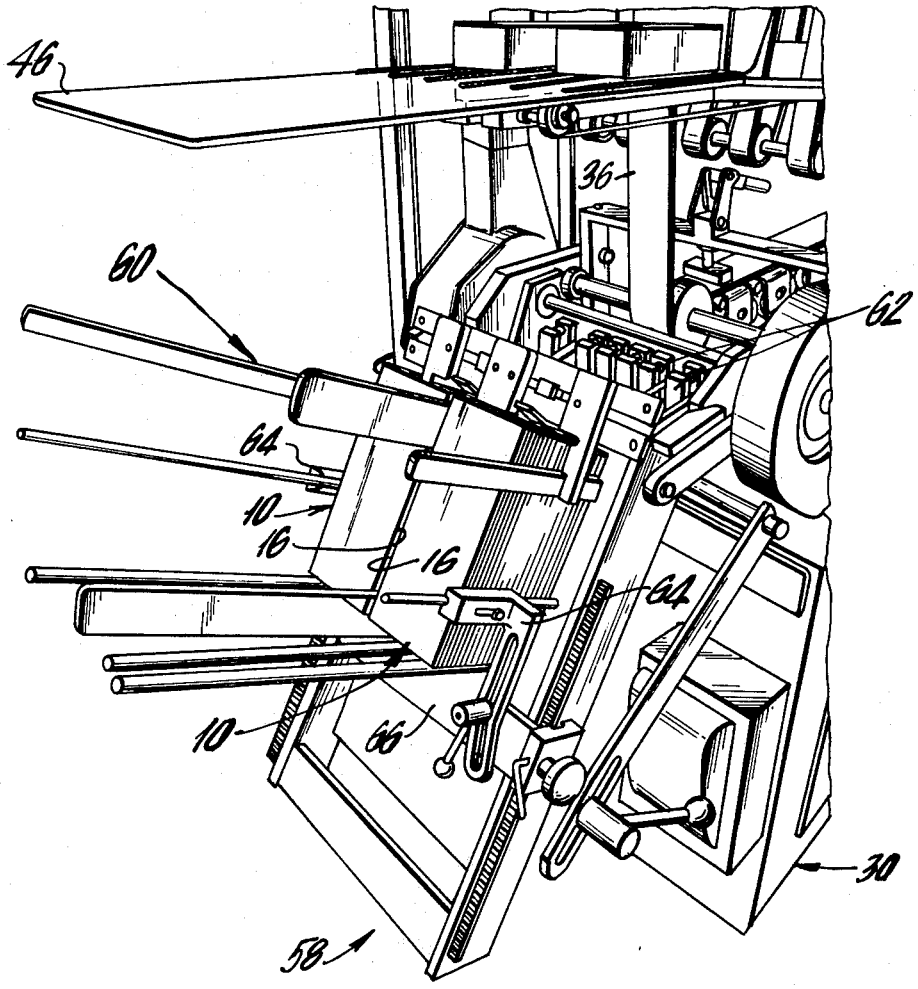
FIG. 3 is a perspective view of the feeding mechanism of the apparatus of the subject invention.

Referring to FIGS. 2, 3 and 8, the apparatus of the subject invention includes a feed assembly 58 of conventional construction having a hopper or chute structure 60 for supporting the articles to which the sealing material is to be applied, such as envelopes 10. The hopper includes a pair of adjustable side plate members 64 and 64, as well as an adjustable cross bar 66. By loosening the side plate members 64 and 64, and the cross bar 66, the hopper may be adjusted laterally and longitudinally to accomodate various sized envelopes.

As shown in FIG. 3, two stacks of envelopes 10 are placed in the hopper or chute 60, with the folded edges 16 being disposed along the central axis of the apparatus. As noted above, the apparatus of the subject invention may be operated with only a single stream of envelopes being coated with adhesive, or alternatively, two streams or arrays of envelopes may be accomodated in the apparatus at the same time, thereby doubling the production capability of the apparatus.

Disposed beneath each envelope stack, in a conventional manner, are a pair of spaced wheel-like feed members which are connected to a suitable gearing means (not shown) which meshes with gearings extending to the drive mechanism for the subject apparatus that is disposed within the stationary supporting structure 30.

Disposed forwardly or inwardly of the feed members is an arrangement of rollers 62 that are connected through suitable gearing (not shown) to the drive mechanism, and which elements 62 are operative to convey envelopes to the feed rollers 63 (see FIG. 8) on each side of the conveyor means 32. As illustrated in the figures, the envelopes are stacked in the hopper with the closure flaps being folded against the body portion 12 of the envelopes, and with the flaps being disposed below the body portion. As each envelope is successively fed between the feed rollers to engage the conveyor means 32 made up of the outer cotton belt 34 and the inner rubber belt 36, the envelopes are aligned in an array, With approximately one foot center to center spacing.

Figure 4:
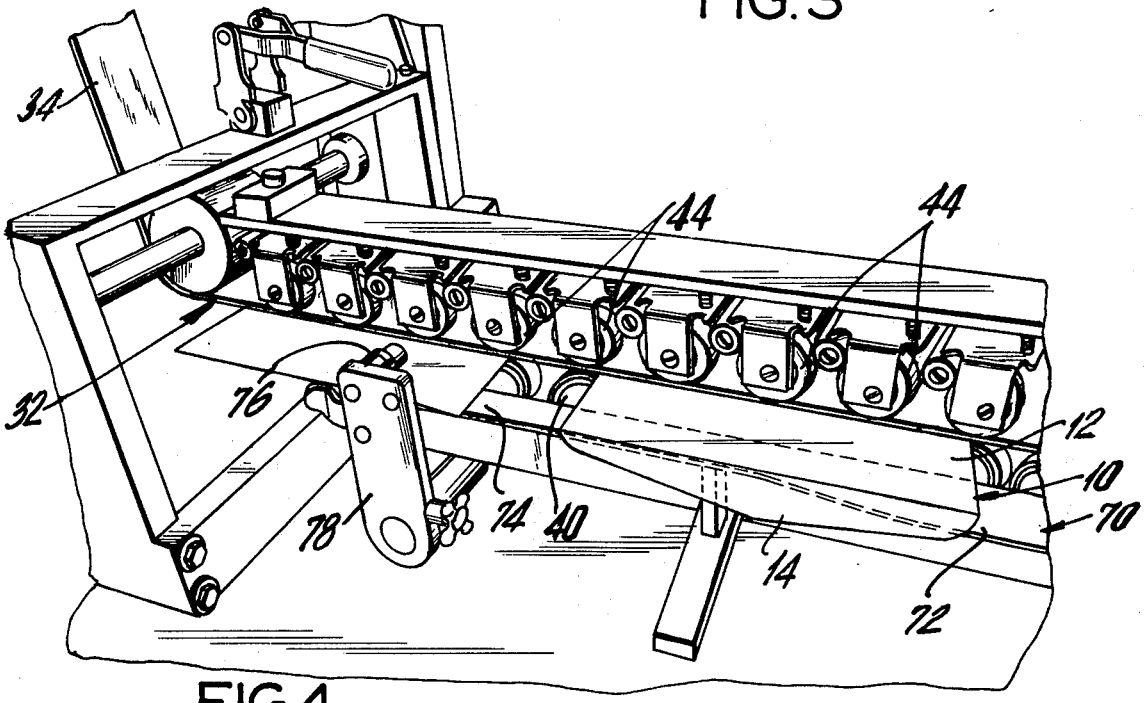
FIG. 4 is a partial perspective view of the apparatus of the subject invention, and more particularly, the means for unfolding the envelope flaps.

Preparatory to applying the latex strips to the closure flap 14 and the body portion 12 of each envelope, it is necessary that the closure flap be unfolded through an angle of approximately 180° so as to extend outwardly from the body portion 12 of the envelope in a direction opposite to the central axis of the conveyor means 32. More particularly, referring to FIG. 4, the unfolding means basically comprises an elongated bar 72 that is rigidly connected to the supporting structure for the conveyor means and which extends generally parallel to the conveyor means 32 along the bottom portion of the triangle path of the conveyor 32. The elongated bar 72 has a tapered end 74 along its left side (as viewed in FIG. 4) so as to rapidly slip between the closure flap 14 and the body portion 12 of each successive envelope as the latter is conveyed. The width of the bar 72 increases along its length, and to aid in the unfolding of each closure flap 14. Disposed upstream of the bar 72 there is provided a small bevelled roller 76A (not shown) that is supported by mounting structure 78 and is positioned below and to the edge as to run along the length of each successive envelope. Approximately ¼ inch inward of the fold line for the closure flap 14 is roller 76. This roller 76 is operative to downwardly deflect the flap of each envelope so as to facilitate the insertion of the unfolding bar 72 betweenn the closure flap 14 and the body portion 12 of each envelope. As the envelope is carried along by the conveyor means 32, the progressively increasing width of the bar 72 causes further unfolding of the closure flap 14 until, at a point at approximately the end of the horizontal run of the conveyor means 32, the closure flap is fully extended, thereby enabling the application of latex sealing material to the inside surface of the closure flap.

Disposed at the lower right hand portion of the path of the conveyor means (as viewed in FIGS. 2, 5 and 8) is the sealing material applicator means 80 of the subject apparatus. The applicator means 80 includes a gumming impression roller 82 disposed against the inner rubber belt 36, while disposed in underset relationship to the conveyor means 32 is an arrangement of a gum box 84, a series of glue transfer rollers 86, and a sealing material applicator roller 88. As more specifically illustrated in FIGS. 2 and 5, the sealing applicator means 80 are driven by a separate motor 90 which is connected through electrical circuitry 92 that is operatively associated with the main drive (housed in structure 30) for the conveyor means 32. By this arrangement, it is possible to vary the speed of operation of the sealing material applicator means 80 relative to the conveyor means 32, and in addition assures a positive and direct drive of the sealing material applicator rollers. Roll 88 (applicator roll) is mounted on a pivotal arm 150 FIG. 8 that can be actuated through suitable linkage 151 by an electric solenoid, 152. Solenoid 152 is actuated by switches 153 and motor control switches. When the main conveyor means 32 motor stops or when no envelopes are engaged in the conveyor means the solenoid 152 is actuated and releases applicator roll 88 from contact with both impression roll 82 and rollers 86. This action stops transfer of sealing material from rollers 86 to roller 82 or to envelopes. This action allows the motor 90 to continue to rotate rollers 86 to keep the sealing material from drying or congealing when the conveyor means has stopped. It is noted that the sealing material applicator means is disposed at a point in the conveyor means where the direction of the movement of the envelopes 10 is changed from a generally horizontal line to a point where they are rotated and conveyed upwardly and generally backwardly. It is at this point that maximum tension exists on the conveyor belts 34, 36, and it is at this point that the impression roller 82 bears up against the backside of the rubber belt 36 of the conveyor, and the envelopes are passed between the nip of the impression roller 82 and the sealing material applicator roller 88. By drawing an imaginary line through the respective axes of the impression roller 82 and the latex applicator roller 88, it is seen that an angle of approximately 45° is obtained relative to the horizontal, and such angle provides the maximum belt tension at the point where the latex sealing material is applied to the envelopes. The latex applicator roller 88 includes dies or stencils 89 that are contoured to stamp the desired shape 18 of sealing material on the closure band 14, and also to stamp the sealing material 20 on the body portion 12 of each envelope 10.

As previously mentioned, following the application of the sealing material to each envelope, the conveyor means 32 carries either the single or the double array of envelopes generally upwardly and backwardly relative to the initial movement of the conveyorr belt 32. At this time the sealing material is then in a moist or wet state, and it is necessary to dry the sealing material. The conveyor then extends through the axial length of a dielectric cryer housing 98 enclosing the dielectric dryer 100 (see FIG. 5). As shown, the housing 98 is a generally rectangular box that is split along the center line so that the top half may be opened for inspection or maintenance of the dielectric dryer assembly housed therein. The conveyor means 32 runs along the axial length of the housing 98 on a slight arc, as more specifically shown in FIG. 8. The conveyor means 32 is supported on a plurality of polypropylene rollers 94 that are approximately 3 inches in diameter. The rollers being made of polypropylene are of a suitable dielectric material that will not pass the current generated by the dielectric dryer 100.

Figure 6:
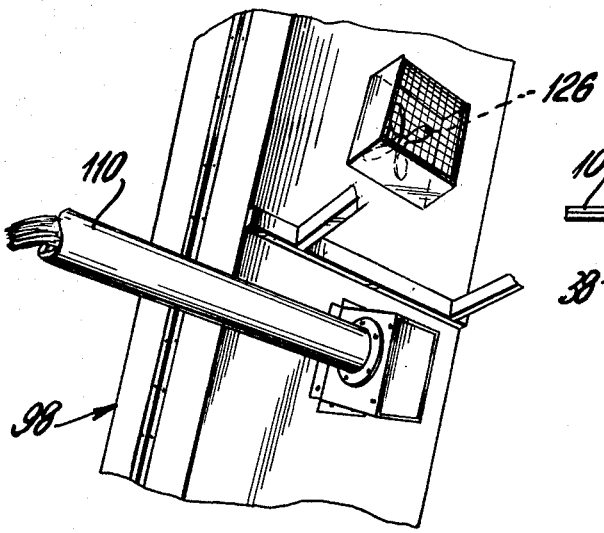
FIG. 6 is a partial perspective view illustrating a portion of the underside of the dielectric dryer housing.

The dielectric dryer includes a grid assembly that is split along its center line and comprises alternating arrangements of current carrying electrodes 102 and ground conductors 104, with each grid assembly being disposed along an angle extending generally downwardly towards the center of the dielectric dryer through which the conveyor means 32 passes. Accordingly, the grid arrangement defines a generally herringbone configuration. The dielectric dryer is operated at approximately 27 megacycles, and the voltage can be varied from 2000 up to 12,000 volts. Every other electrode is a ground electrode, the ones between, of course would be positive electrodes. The ground electrodes 104 are connected to the body housing 98 while the positive electrodes are carried back to a central coaxial cable 110 (see FIG. 6) that is disposed at a point intermediate the length of the housing 98. The position of the central cable 110 is provided in order to maintain a uniform dielectric drying field in the housing, and thus a single input coaxial cable is provided, and the individual feed lines extending from that single coax to the positive electrodes.

Figure 5A:
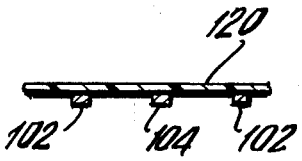
FIG. 5a is a partial sectional view taken along line 5a-5a in FIG. 5.

Disposed on top of the dielectric grid arrangement is a sheet of dielectric material 120 (see FIG. 5a), such as Teflon, which functions to keep the moisture that is driven off from the latex sealing material applied to the envelope from going down between the electrodes in the dielectric grid assembly and possibly causing an electrical short. In addition, in order to remove excess moisture generated within the housing 98, a fan 126 (see FIG. 6) may be provided so as to withdraw the moist air from within the housing 98. After the conveyor 32 leaves the dielectric dryer housing 98, it passes over a conveyor take-up pulley 130 (see FIG. 8) that is mounted on a shaft 132 which may be adjusted by means of an adjustment slot 134 in the support structure secured to the stationary supporting structure 30. The envelopes 10 are than conveyed from the conveyor take-up pulley 130 generally downwardly and at an angle to a point at which the outer canvas belt 34 passes over conveyor idler pulley 50, while the inner rubber belt 36 continues generally downwardly to its initial position adjacent the feed assembly 58. An endless continuous delivery belt 140 is provided and includes pusher fingers 142 that are adapted to engage the last envelope positioned on the delivery table 46, and push the stacked envelopes 10 away from the inner rubber conveyor belt 36, thereby enabling the succeeding envelope to fall onto the delivery table 46. It is noted that the feed assembly 58 and the stacking delivery table 46 are disposed in the same vicinity thereby enabling the operator to readily load and unload the envelopes 10 at the same general location of the apparatus of the subject application.

An electronic counter is provided for counting envelopes 10 as they exit the machine on table 46. The counter is affected by photocell 162 FIG. 8 through suitable commercial electronic batch counters and actuates solenoid 160. Solenoid 160 in turn through suitable linkage moves an envelope out of position in the stack to show a "count" or predetermined unit of measure.

In the subject method for applying sealing material to the flap closure 14 and the body portion 12 of envelopes 10, the envelopes are fed in linear array to the conveying means 32 which grips each envelope along its folded edge 16 (see FIG. 1), with the flap closure being disposed below the plane of the envelope. As the envelopes progress along the conveyor, each flap closure is rotated about its fold line to a generally horizontal position preparatory to the application of the sealing material. Next, sealing material is applied to the flap closure and the body portion 12 of the envelope, and the "wet" envelopes are then passed in linear array through the dielectric dryer 98. As the envelopes leave the dryer 98, the latex adhesive is substantially dried, after which the envelopes are conveyed to the delivery table 46. As set forth above, two linear arrays of envelopes may be conveyed at the same time and prebending of each envelop may be effected prior to the rotating of the folding of the flap closure to the generally horizontal position.

It will thus be seen that with the apparatus of the subject invention, sealing material may be automatically applied to the adjacent flap closure and body portions of each envelope of a series of envelopes in an exact, predetermined location, and the envelopes are conveyed and handling so that they can be effectively dried, whereupon, on reaching a point adjacent their original feeding location, the envelopes are in a finished condition. It will furthermore be appreciated that the machine of the subject invention is adapted to handle various sized envelopes and applies the sealing material to all such envelopes in a speedy, efficient manner, so that a large number of envelopes will be completed every minute that the machine is in operation. Along these lines, it is noted that the machine of the subject invention is capable of processing 500 envelopes per minute up to an envelope size of 6 × 10 inches. For envelopes of a size of from 6 × 10 inches and up to 10 × 12 inches, the apparatus of the subject invention is capable of processing 250 envelopes per minute. While the subject apparatus has been described as applying sealing material to flat sheets or articles where a sealing operation is required.

While the subject apparatus and method have been described in connection with a preferred embodiment, it will be understood that it is not intended to limit the invention. On the contrary, it is intended to cover all alternatives, modifications and equivalents as may be included within the spirit and scope of the invention as defined by the appended claims.

The embodiments of the invention in which an exclusive property or privilege is claimed are defined as follows:

1. Apparatus for applying sealing material to the flap closures of a plurality of envelopes, each including a body portion having a folded edge portion opposite said flap closure, comprising:

an endless, continuous conveyor means conveying a succession of envelopes in linear array, said conveyor means gripping each envelope along the folded edge thereof, with the flap closure being disposed below the plane of the envelope;

feed mechanism means in adjacent relation to said conveyor means, and which sequentially feeds the envelopes for engagement by said conveyor means;

folding means in adjacent relation to said conveyor means whereover said conveyor means carries along said envelopes, and which is adapted to unfold the flap closure of each envelope to a generally horizontal position;

sealing material applicator means in adjacent relation to said conveyor means whereover said conveyor means carries along said envelopes, and which is adapted to apply sealing material to one or more surfaces of the envelope;

dielectric dryer means in adjacent relationship to said conveyor means whereover said conveyor means carried along said envelopes, and which is provided to dry the sealing material applied to the envelopes; and envelope stacking means in adjacent relation to said conveyor means whereto said conveyor means carried along said envelopes, and which is adapted to remove from said conveyor means the envelopes to which sealing material has been applied, said continuous conveyor means extending in a generally horizontal direction over the folding means, extending upwardly and rearwardly at the point at which the sealing material applicator means is disposed, extending upwardly and rearwardly past the dielectric drying means, and extending downwardly and rearwardly past the envelope stacking means prior to returning to its initial position adjacent the feed mechanism means.

2. Apparatus for applying sealing material as in claim 1 wherein said conveyor means includes a pair of back-to-back endless belt members having adjacent run portions spaced from each other a distance such as to properly engage, support and move the envelopes in said predetermined direction.

3. Apparatus for applying sealing material as in claim 2 wherein one of said belts includes a V-shaped projection, and wherein the drive means for the conveyor belt comprises a series of V-shaped drive rollers adapted to engage the V-shaped projection of said one belt.

4. Apparatus for applying sealing material as in claim 1 wherein said folding means includes a tapered bar member positioned with respect to the conveyor means so as to project between the flap closure and the body portion of the envelope whereby as said conveyor means carried along said envelopes, the bar portion causes the flap closure to rotate relative to the body portion to a generally horizontal position.

5. Apparatus for applying sealing material as in claim 4 further including a bearing member disposed in overset relation to said conveyor means in the vicinity of said folding bar, which bearing means engages the upper portion of the envelope adjacent the fold line of the flap closure in order to aid in the folding of the flap closure to a generally horizontal position.

6. Apparatus for applying sealing material as in claim 1 wherein said sealing material applicator means includes a sealing material gum box, a plurality of glue transfer rollers, and a glue roller having a die portion to which the glue transfer rollers apply the sealing material, which die portion successively engages the linear array of envelopes so as to apply the sealing material to the surface of the flap closure.

7. Apparatus for applying sealing material as in claim 1 wherein said dielectric dryer means comprises an alternating arrangement of a plurality of generally parallel electrodes and ground conductors, which are connected to a central power supply.

8. Apparatus for applying sealing material as in claim 1 wherein said dielectric dryer means further includes an encasing structure completely surrounding the dielectric dryer means along the length thereof.

9. Apparatus for applying sealing material as in claim 1 wherein said dielectric dryer means further includes fan means secured to the encasing structure and operative to remove excess moisture developed within the dielectric dryer.

10. Apparatus for applying sealing material as in claim 1 wherein said conveyor means grips two linear arrays of envelopes, one on each opposite side of said conveyor means.

11. Apparatus for applying sealing material as in claim 1 wherein the dielectric dryer means includes two parallel arrangements of alternating electrodes and ground conductors, each array being disposed at an angle to the length of the conveyor means so as to create an arrangement of electrodes and ground conductors within the dielectric dryer means.

12. Apparatus for applying sealing material as in claim 1 wherein said sealing material applicator means applies sealing material to both the flap closure and the body portion of the envelope.

13. Apparatus for applying sealing material as in claim 12 wherein the sealing material is latex.

14. Apparatus for applying sealing material as in claim 1 wherein the path of the endless, continuous conveyor means is generally triangular, and wherein the feed mechanism means and the envelope stacking means are disposed adjacent one another along the path of the conveyor means.

15. Apparatus for applying material to the facing closure flap and body portion of an envelope comprising;

drive means;

an endless continuous conveying means connected to said drive means for conveying a series of envelopes, said conveying means gripping each envelope along a folded edge portion thereof;

feeding means for successively feeding each envelope onto the conveying means in a generally horizontal plane, with the flaps facing downwardly;

flap opening means for unfolding the flaps to generally horizontal positions;

sealing material applicator means for selectively applying sealing material to the facing flap and body portions of the envelope;

dielectric drying means for drying the sealing material;

means for counting the envelopes; and means for removing the envelopes from the conveyor means, said flap opening means, said material applicator means, said dielectric drying means, said counting means, and said removing means being disposed in sequence along the path of said conveying means, and wherein the path of the endless continuous conveying means is generally triangular in configuration, and with the feeding means and the means for removing the envelopes from the conveyor means being located in the same general vicinity so as to enable the operator of the apparatus to feed and remove envelopes from the machine from a central location.

16. Apparatus for applying sealing material to the closure flap and facing body portion of an envelope as in claim 15 wherein said flap opening means includes a tapered bar positioned with respect to the conveying means so as to project between the flap closure and the body portion of the envelope for rotating the flap closure relative to the body portion to a generally horizontal position, and further including a bearing member disposed above said tapered bar for engaging the upper portion of the envelope adjacent the fold line of the flap closure for facilitating the folding of the flap closure to the generally horizontal position.

17. Apparatus for applying sealing material to the facing closure flap and body portion of an envelope as in claim 15 wherein said conveying means includes a pair of back-to-back endless belt members having adjacent run portions spaced from each other a distance so as to properly engage, support, and move the envelopes in said predetermined direction.

18. Apparatus for applying sealing material to the facing closure flap and body portion of a envelope as in claim 17 wherein the inner belt is made of rubber, and the outer belt is made of canvas.

19. Apparatus for applying sealing material to the facing closure flap and body portion of an envelope as in claim 15 wherein said sealing material applicator means includes a sealing material gum box, a plurality of glue transfer rollers, and a glue roller having die portions to which the glue transfer rollers supply the sealing material, which die portions successively engage the series of envelopes so as to apply the sealing material to the surface of the flap closure, and a motor for driving said glue transfer rollers and the glue roller, wherein said glue transfer rollers are mounted through linkage means actuated by control means to stop the supply of glue from said glue transfer rollers when the motor is out of operation or when the flow of envelopes is interrupted, the operation of said motor for driving said rollers being coordinated with the drive means for the endless continuous conveying means.

20. Apparatus for applying sealing material to the facing closure flap and body portion of an envelope as in claim 15 wherein said endless continuous conveying means grips two series of envelopes, one on each opposite side of said conveyor means, and wherein said sealing material applicator means includes two sets of rollers, one for each series of envelopes.

21. Apparatus for applying sealing material to the facing closure flap and body portion of an envelope as in claim 17 wherein the sealing material is latex.

22. Apparatus for applying sealing material to the facing closure flap and body portion of an envelope as in claim 15 wherein the dielectric drying means includes an alternating arrangement of a plurality of generally parallel conductors and ground conductors, which are connected to a central power source.

23. Apparatus for applying sealing material to the facing closure flap and body portion of an envelope as in claim 22, further including an encasing housing structure surrounding the dielectric drying means along the length thereof.

* * * * *